US009656838B2

(12) United States Patent
Weckbecker et al.

(10) Patent No.: US 9,656,838 B2
(45) Date of Patent: May 23, 2017

(54) METHOD FOR INFLUENCING A CABLE WINCH FORCE ACTING ON A CABLE DRIVE AND DEVICE FOR CARRYING OUT A METHOD OF THIS TYPE

(71) Applicant: Terex Cranes Germany GmbH, Zweibrücken (DE)

(72) Inventors: Alfons Weckbecker, Zweibrücken (DE); Nico Fragetti, Straubenhardt (DE); Marc Krebs, Rohrbach-lès-Bi (FR)

(73) Assignee: TEREX CRANES GERMANY GMBH, Zweibrücken (DE)

( * ) Notice: Subject to any disclaimer, the term of this patent is extended or adjusted under 35 U.S.C. 154(b) by 332 days.

(21) Appl. No.: 14/173,353

(22) Filed: Feb. 5, 2014

(65) Prior Publication Data

US 2014/0217340 A1 Aug. 7, 2014

(30) Foreign Application Priority Data

Feb. 5, 2013 (DE) ..... 10 2013 201 860

(51) Int. Cl.
*B66D 1/50* (2006.01)
*B66C 13/18* (2006.01)
*B66D 1/74* (2006.01)

(52) U.S. Cl.
CPC ..... *B66D 1/50* (2013.01); *B66C 13/18* (2013.01); *B66D 1/505* (2013.01); *B66D 1/741* (2013.01)

(58) Field of Classification Search
CPC . B66D 1/50; B66D 1/505; B66D 1/74; B66D 1/741; B66D 1/7405; B66D 1/7415; B66D 1/76; B66C 1/18
See application file for complete search history.

(56) References Cited

U.S. PATENT DOCUMENTS 4,172,529 A 10/1979 Bryan, Jr.
4,204,664 A 5/1980 Bryan, Jr.
(Continued)

FOREIGN PATENT DOCUMENTS

DE 2301623 A1 7/1974
DE 2451547 A1 5/1976
(Continued)

*Primary Examiner* — Sang Kim
*Assistant Examiner* — Nathaniel Adams
(74) *Attorney, Agent, or Firm* — Browdy and Neimark, PLLC

(57) ABSTRACT

A method for influencing a cable winch force acting on a cable drive, comprises the method steps providing a cable drive with a drivable winch and with a cable that can be wound on the winch, providing a device for producing a traction sheave cable force on the cable, determining an outer cable force, predetermining a cable drive operating state, providing a control-regulating unit to influence the traction sheave cable force, producing a control-regulating variable by means of the control-regulating unit depending on the outer cable force and the predetermined cable drive operating state, producing the traction sheave cable force by means of the device and influencing the traction sheave cable force by means of the control-regulating unit in such a way that the cable winch force acting on the cable drive can be controlled depending on the respective cable drive operating state and the outer cable force, wherein the device is a traction sheave drive, wherein a four-quadrant operation of the traction sheave drive is reproduced by means of the control-regulating unit, and wherein the four traction sheave drive operating states are no-load lifting, no-load lowering, load lifting and load lowering.

12 Claims, 7 Drawing Sheets

(56) References Cited

U.S. PATENT DOCUMENTS

| | | | | |
|---|---|---|---|---|
| 5,887,735 | A * | 3/1999 | Abel | B66C 23/90 212/277 |
| 6,989,640 | B2 * | 1/2006 | Yoshimatsu | E02F 9/2075 318/140 |
| 7,134,645 | B1 * | 11/2006 | Johnson | B66D 1/741 254/338 |
| 7,258,242 | B2 | 8/2007 | Irsch et al. | |
| 7,416,169 | B2 | 8/2008 | Noeske et al. | |
| 7,722,013 | B2 | 5/2010 | Franzen et al. | |
| 2003/0057916 | A1 | 3/2003 | Davis et al. | |
| 2005/0017228 | A1 | 1/2005 | Werner | |
| 2007/0113640 | A1 | 5/2007 | De Jesus et al. | |
| 2010/0262384 | A1 | 10/2010 | Marfani et al. | |
| 2011/0130863 | A1 * | 6/2011 | Porma | B66C 13/23 700/213 |

FOREIGN PATENT DOCUMENTS

| | | | |
|---|---|---|---|
| DE | 3819447 | C2 | 5/1990 |
| DE | 102004046130 | A1 | 4/2006 |
| DE | 102007031227 | A1 | 1/2008 |
| EP | 1641703 | A1 | 4/2006 |
| EP | 1773706 | A1 | 4/2007 |
| EP | 1924520 | A1 | 5/2008 |
| FR | 2843954 | A1 | 3/2004 |
| WO | 2009027580 | A1 | 5/2009 |

* cited by examiner

METHOD FOR INFLUENCING A CABLE WINCH FORCE ACTING ON A CABLE DRIVE AND DEVICE FOR CARRYING OUT A METHOD OF THIS TYPE

CROSS-REFERENCES TO RELATED APPLICATIONS

This application claims the priority of Patent Application Serial No. DE 10 2013 201 860.6 filed on Feb. 5, 2013, pursuant to 35 U.S.C. 119 (a)-(d), the content of which is incorporated herein as if fully set forth herein.

FIELD OF THE INVENTION

The invention relates to a method for influencing a cable winch force acting on a cable drive and a device for carrying out a method of this type.

BACKGROUND OF THE INVENTION

Devices for winding a cable onto a winch of a cable drive are known from DE 10 2004 046 130 A1, from FR 2 843 954 A1, DE 24 51 547 A1, DE 23 01 623 A1, DE 38 19 447 C2, DE 10 2007 031 227 A1, U.S. Pat. No. 4,172,529 and from U.S. Pat. No. 4,204,664.

SUMMARY OF THE INVENTION

An object of the present invention is to improve a method for influencing a cable winch force acting on a cable drive in such a way that the cable winch force acting on the cable drive can be controlled depending on a respective cable drive operating state and an outer cable force.

This object is achieved by a method for influencing a cable winch force acting on a cable drive, comprising the method steps of providing a cable drive with a drivable winch and with a cable that can be wound on the winch, providing a device for producing a traction sheave cable force on the cable, determining an outer cable force, predetermining a cable drive operating state, providing a control-regulating unit to influence the traction sheave cable force, producing a control-regulating variable by means of the control-regulating unit depending on the outer cable force and the predetermined cable drive operating state, producing the traction sheave cable force by means of the device and influencing the traction sheave cable force by means of the control-regulating unit in such a way that the cable winch force acting on the cable drive can be controlled depending on the respective cable drive operating state and the outer cable force, wherein the device is a traction sheave drive, wherein a four-quadrant operation of the traction sheave drive is reproduced by means of the control-regulating unit, and wherein the four traction sheave drive operating states are no-load lifting, no-load lowering, load lifting and load lowering.

It was recognised according to the invention that a cable winch force can be controlled depending on a respective cable drive operating state and on an outer cable force by exerting a traction sheave cable force on a cable of a cable drive. By combining the cable drive, which basically allows only two operating states, with a device for producing a traction sheave cable force, which is, in particular, configured as a traction sheave drive, four different operating states can be reproduced. As a result, it is possible to influence a cable winch force acting on the cable drive, which can be determined, in particular, by means of a cable force measuring unit, in such a way that the cable winch force can be controlled depending on a cable drive operating state and on an outer cable force. Controlled and low-wear winding is made possible in that the cable is wound on at a cable winch force which is as constant and, in particular, low as possible. An additional drive of the cable in front of the winch can make this possible. This drive principle is based on the cable friction according to the Euler-Eytelwein formula. An acceptable tolerance range of the cable winch force, which is, in particular, +/−20% of a predetermined desired cable winch force, is taken to mean a constant cable winch force. In particular, the acceptable cable winch force range comprises +/−10% of the predetermined desired cable winch force and, in particular, +/−5% of the predetermined desired cable winch force. For example, a value of 2% of a minimum breaking force of the cable or of 10% of the nominal force of the cable drive is used as the desired cable winch force, which is used to prestress the cable for optimal winding or unwinding of the cable. By means of a cable, the device can be connected at a first cable end to the cable drive and at a second cable end to a load receiving device, such as, for example, a load hook, in particular a hook block. The cable in particular, in each case, loops the two traction sheaves. The cable drive operating state is fixed by an actuating direction of the cable drive, for example by a rotational direction of a winch of the cable drive, in other words a winding or unwinding of the cable. An outer cable force is caused, in particular by a load received by the load receiving device. Various traction sheave drive operating states can be determined depending on the respective cable drive operating state and depending on the outer cable force for a provided device for producing a traction sheave cable force on the cable. Four traction sheave drive operating states are produced, in other words with or without a load suspended on the load receiving device and the winding or unwinding of the cable from the winch of the cable drive. These traction sheave drive operating states are designated no-load lifting, i.e. winding the cable without a load, no-load lowering, i.e. unwinding the cable without a load, load lifting, i.e. winding the cable with a load and load lowering, i.e. unwinding the cable with a load. In particular, it is therefore possible using the method according to the invention to both wind and unwind the cable in a controlled manner, in other words at a constant cable winch force, it being unimportant whether the cable drive is loaded by an outer load, i.e. whether a load is suspended on the load receiving device or not. Wear to the cable, in particular on a winch wound in several layers, is reduced. Since, a monitoring and adaptation of the cable winch force is made possible in particular also when winding the cable onto the winch of the cable drive, winding errors and/or a cable fault as a result of a too loose, unstable cable assembly can be avoided. In particular, it can be avoided that a cable wound on incorrectly in this manner, which is then subject to a strong outer cable force as a result of a high outer load, is drawn in or forced in from an upper layer of a cable winding into deeper layers located therebelow with a looser winding. This form of cable damage is ruled out by the method according to the invention. Additional cable-braking devices, which are called cable baiters, can be dispensed with in the method according to the invention.

In particular, a four-quadrant operation of the traction sheave drive can be reproduced by means of a control-regulating unit.

Additional operating states are made possible thereby, which are not depicted by means of a two-quadrant operation known from DE 10 2004 046 130 A1 for producing a constant load when winding a cable onto the cable drive. In particular, the method according to the invention allows additional operating states to be depicted. The depiction of the additional operating states takes place by means of an adjustment of the operating states in an incremental control range. This means that the control of the cable force acting on the cable drive is also possible for the additional operating states of load lowering and no-load lowering. The cable guidance and the cable stress are thereby improved. In particular, the situation is ruled out of a so-called hanging cable or slack cable being produced as a result of low stressing of the cable, as, because of the outer cable force, the cable is not stressed by adequate tensile loading. An inadequate tensile loading may be present when, for example, the loading of the cable is only provided by a suspended hook or a reeved load block, and, in particular, an outer load is absent. Furthermore, it can be ruled out that a tearing of the cable will occur as a result of over-stressing. In particular, a method of this type can be advantageously used for mutual control of multiple cable receiving in double cable operation. In multiple cable receiving, the cables can be decelerated very differently because of cable braking forces caused by the sheaves. In this case, a compensation of the cable forces takes place in such a way that a tilting, in other words, a twisting of a double load block is avoided with, in particular, additional devices, which are known from EP 1 924 520 B1 and/or from EP 1 773 706 B1 for avoiding the tilting of a double load block, not being required. These cable force differences can already be dynamically taken into account and avoided, in particular compensated, in the cable run during four-quadrant operation. It is conceivable that a method in the four-quadrant operation mentioned of the traction sheave drive will for the first time allow a double cable drive with extremely long cable lengths of, for example, more than 1000 m.

It is advantageous if the traction sheave drive has a drive motor, in particular an electric motor, which, depending on the cable drive operating state, provides a torque of a required size, so that a traction sheave cable force caused by the cable sheave drive leads to a desired cable winch force. In particular, a control algorithm of the traction sheave drive depends directly on the cable drive operating state.

A method according to which the cable winch force acting on the cable drive can be controlled in such a way that it is reduced or increased relative to the outer cable force allows an advantageous control of the cable winch force in relation to the outer cable force.

A method according to which the cable winch force acting on the cable drive can be controlled in such a way that the traction sheave cable force follows a predetermined characteristic curve depending on the outer cable force allows a rapid and effective control of the cable winch force.

A method according to which the outer cable force is determined indirectly from the load force allows a rapid and uncomplicated determination of the outer cable force.

A method according to which the outer cable force is determined directly by means of a cable force measuring device allows a particularly precise determination of the outer cable force.

A method according to which the traction sheave cable force is determined that can be transmitted by means of the device from the outer cable force allows the traction sheave cable force to be monitored.

A method according to which the rotational direction of the winch, which is predetermined, in particular, by an operator, is considered to produce the control-regulating variable allows improved control of the cable winch force.

A method according to which a plurality of input variables, in particular the outer cable force, the load force, the rotational direction and/or the rotational speed of the winch, is used to produce the control-regulating variable allows various influencing variables for producing the control-regulating variable to be taken into account.

A method according to which the traction sheave cable force is controlled in such a way that the resulting cable winch force is independent of the rotational speed of the winch allows a control of the traction sheave cable force in such a way that the resulting cable winch force is independent of the rotational speed of the winch. The traction sheave cable force reacts directly to a change in the outer cable force due to the pressure level in the closed control circuit. The method is independent of the speed of the cable and, in particular, of accelerations or decelerations of the cable.

A further object of the present invention is to improve a device for influencing a cable winch force acting on a cable drive, in order, in particular, to reduce cable wear and to avoid winding errors when winding the cable.

This object is achieved by a device for carrying out a method according to any one of the preceding claims, wherein the device comprises two traction sheaves that can be looped by a cable and at least one drive to drive at least one of the traction sheaves, wherein a traction sheave cable force is produced on the cable by means of the traction sheaves and is influenced by means of a control-regulating unit in such a way that the cable winch force acting on the cable drive can be controlled depending on a respective cable drive operating state and an outer cable force.

According to the invention, it was recognised that two traction sheaves are used to exert a traction sheave cable force on a cable of a cable drive, the traction sheaves being drivable independently of one another at least by means of one drive and, in particular, by means of a drive in each case. The device ensures that the cable force acting on the cable drive is monitored independently of the respective operating type of the cable drive. The traction sheave drive can thus be controlled independently of the cable drive. It is thus possible by means of the two traction sheaves to assist the winding and unwinding of the cable from the winch of the cable drive in a targeted manner, i.e. to load the winch of the cable drive or to relieve it. Because of the assisting effect of the traction sheave cable force, the winch of a primary cable drive can be designed to be smaller and, in particular, with a reduced power and brake. As a result, the total weight of the winch arrangement of a work machine can be reduced and the cost outlay reduced. It is also possible to retrofit said device on an already existing work machine. When the device is configured as a refitting kit for an existing work machine, it is, in particular, unnecessary to place increased safety demands on the traction sheaves, as functions relevant to safety such as, for example, a braking function have to be satisfied in any case on the cable drive present on the work machine. In particular, the same safety demands are made of the device as a retrofitting kit as of a primary cable drive. Even a temporary failure of the device, for example the traction sheaves icing over can be tolerated. The device, as a retrofitting kit, can be implemented in an uncomplicated manner, in particular with reduced functions, and economically. It is possible to provided pre-equipped brackets and/or hydraulic lines on an intermediate piece in order to simplify later retrofitting of the device according to the invention. It is advantageous to provide, in the geometric vicinity of a traction sheave drive, a self-sufficient hydraulic unit, which is known, for example, from EP 1 641 703 B1 and to already set up the necessary cables for this beforehand.

A device in which the control-regulating unit has a signal connection to the at least one drive to control or regulate the drive torque and/or drive rotational speed of the drive allows an automatic adaptation and control of the traction sheave cable force by controlling the drive torque and/or drive rotational speed of at least one of the drives.

A device in which the at least one drive is a hydraulic motor, an electric motor or a motor-gearing combination allows a simplified and direct activation of the drives. In particular, it is advantageous for a predetermined desired torque to be able to be directly produced and activated. A device with hydraulic drives for the traction sheaves can be can be realised in an uncomplicated and economical manner. In particular, it is possible to provide a supply of the hydraulic drives by means of a hydraulic mechanism which is present in any case on a work apparatus. It is also possible for the hydraulic drives to be activated by a closed, self-sufficient hydraulic circuit. The use, in particular, of frequency-controlled electric motors allows a direct and more precise control of the drive torque. The electric motors can also be more easily integrated into a possible control loop. A control geared at this can take place close to real time. Moreover, electric motors have improved efficiency compared to hydraulic drives. The environmental pollution is reduced due to reduced emissions. The drive can also be configured as a motor-gearing combination. A combination of this type allows a particularly compact implementation of the drive. The drive can thereby be arranged, in particular, advantageously on the device and, overall, allows a compact, weight-reduced configuration of the traction sheave drive.

A device in which the at least one drive has an automatic torque control allows a simplified and effective control of the traction sheaves.

A device in which each traction sheave has a plurality of grooves for cable guidance allows a targeted and, in particular, robust cable guidance on the traction sheaves. In particular an overlaying of individual cable strands in the device is avoided. A device in which the traction sheaves in each case have a different number of grooves and, in particular, one traction sheave has precisely one groove more than the respective other traction sheave, allows an advantageous cable guidance.

A device in which the traction sheaves are arranged in a receiving frame allows an uncomplicated and simultaneously stable arrangement of the device on a work machine, in particular a crane.

An embodiment of the invention will be described in more detail below with the aid of the drawings.

DESCRIPTION OF THE PREFERRED EMBODIMENT

Figure 1:
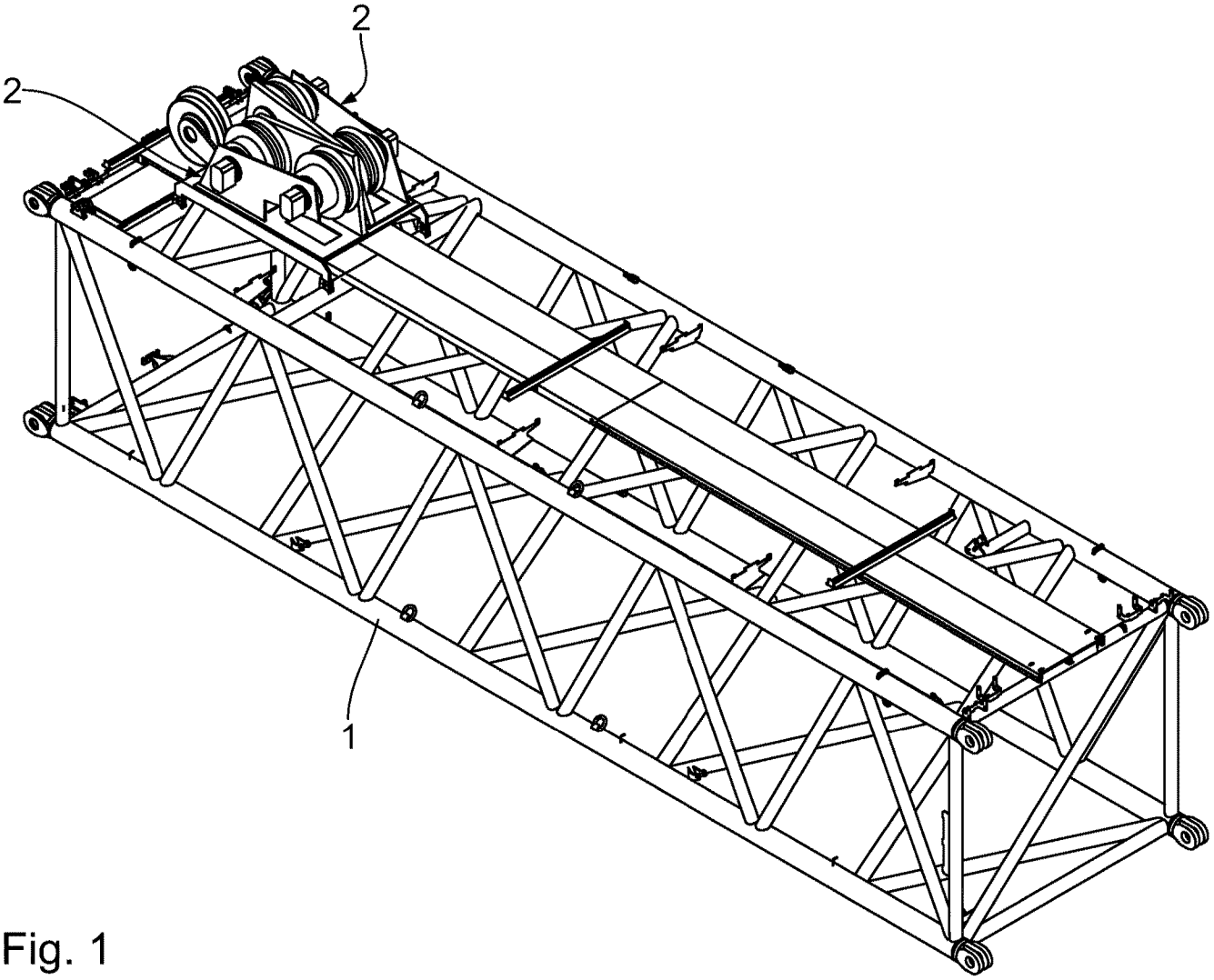
FIG. 1 shows a perspective view of a lattice boom of a crane with two devices according to the invention.

FIG. 1 shows a lattice boom 1 of a crane, which, in particular, may be configured as a boom crane. Two devices 2 according to the invention are fastened to the lattice boom 1. The devices 2 are arranged along a cable guide of a cable drive, not shown, between a winch, not shown, of the cable drive and a load receiving device, not shown, to receive an outer load. Since two devices 2 are arranged on the lattice boom 1, the operation of a double hook block as the load receiving device is possible. It is also possible to use precisely one, or more than two devices 2 to operate a hook block on a work machine.

The use of the device 2, which is configured as a traction sheave drive, can be applied to various work machines, in particular a crawler crane.

Figure 2:
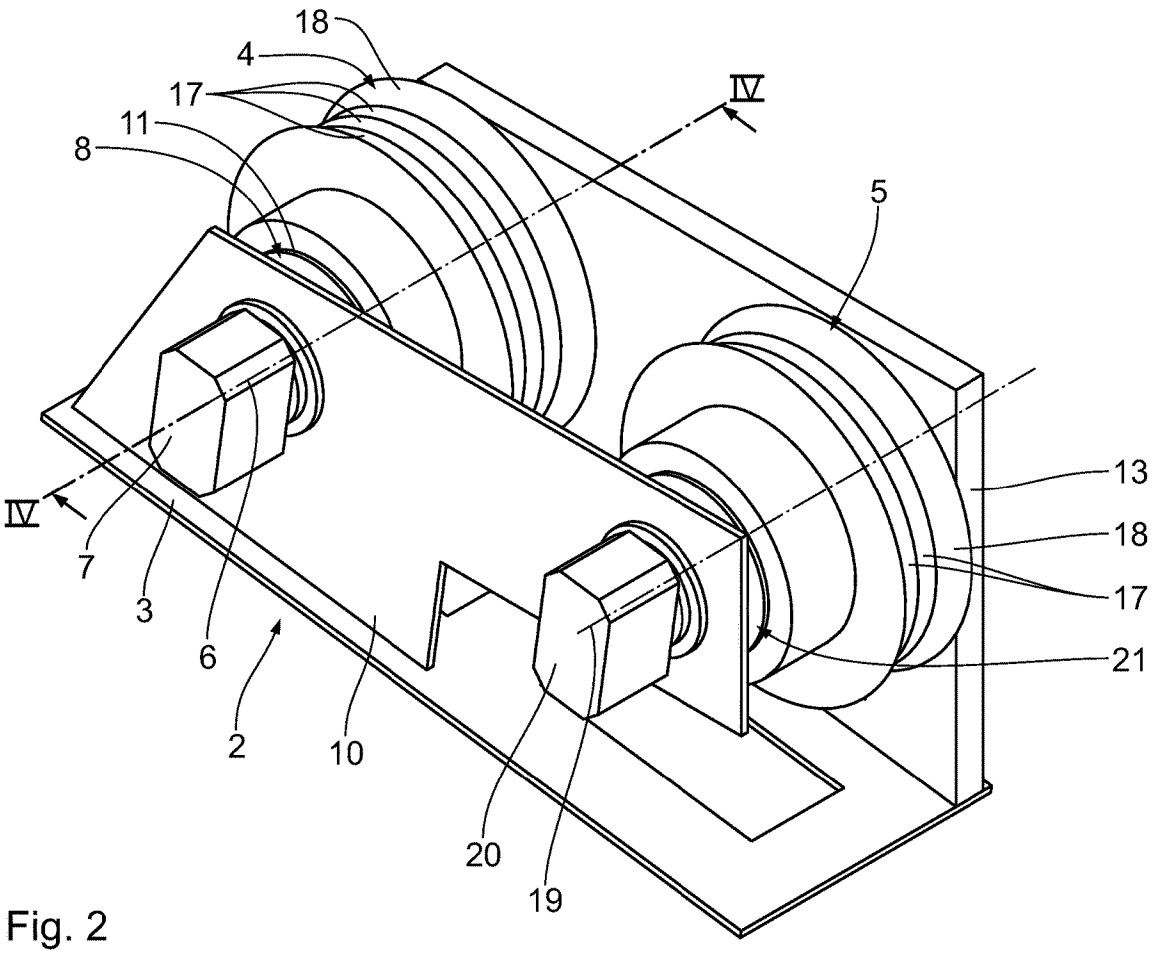
FIG. 2 shows an enlarged detailed view of a device according to FIG. 1.
Figure 3:
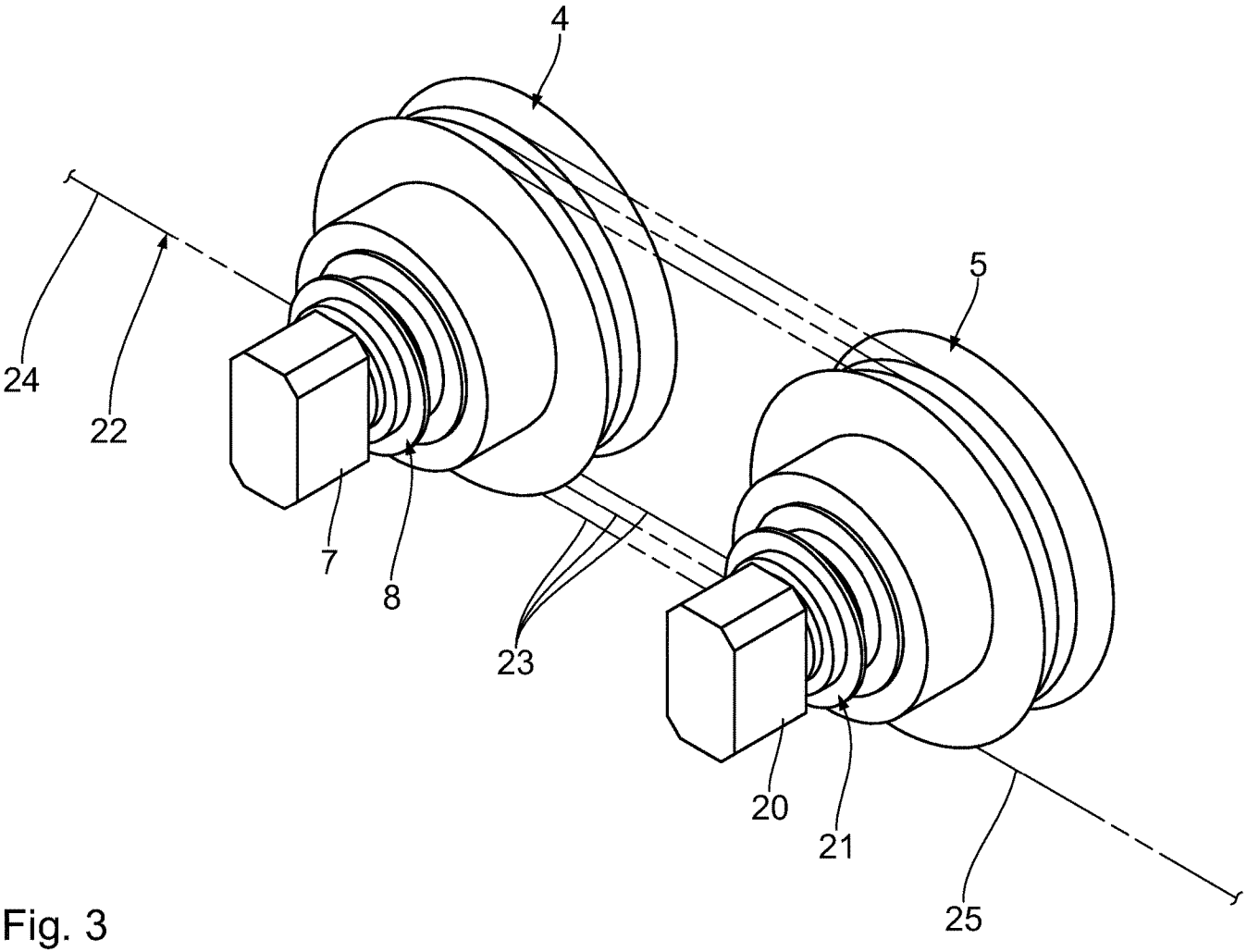
FIG. 3 shows a view of a cable guidance on the device, corresponding to FIG. 2.
Figure 4:
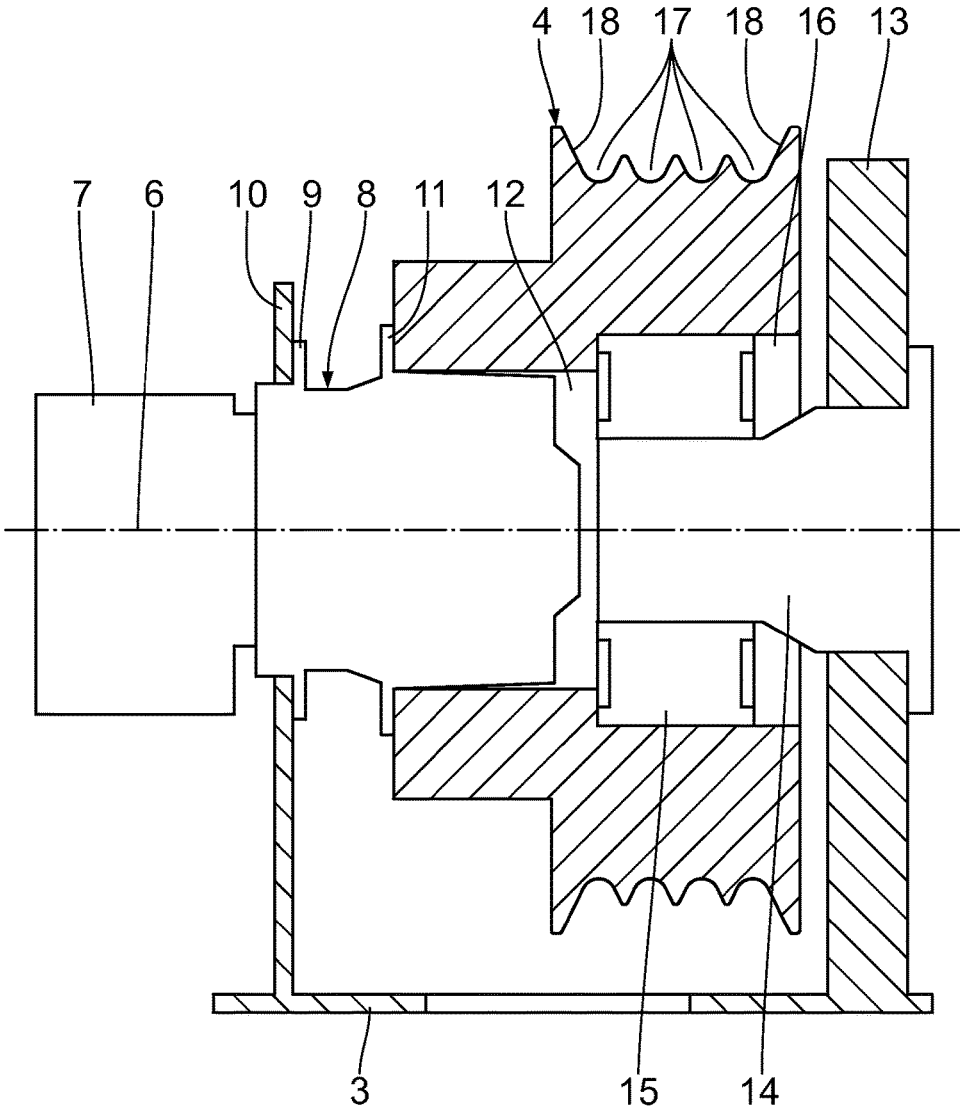
FIG. 4 shows a sectional view along the line IV-IV in FIG. 2.

The device 2 will be described in more detail below with the aid of FIGS. 2 to 4. The device 2 has a receiving frame 3 in which a first traction sheave 4 and a second traction sheave 5 are arranged. The first traction sheave 4 is driven about its rotational axis 6 by a first drive 7 by means of a first gearing 8. The first drive 7 is configured as a hydraulic drive. The first gearing 8 is held by means of a first flange 9 on a vertical wall 10 of the receiving frame 3 in the axial direction of the rotational axis 6. The first gearing 8 furthermore has a second flange 11, on which the first traction sheave 4 is held in the axial direction along the rotational axis 6. The first traction sheave 4 is placed with a gearing opening 12 on the first gearing 8. For simplified assembly of the device 2, the first gearing 8 is configured to be conically tapering in a portion to be received in the gearing opening 12.

A bearing journal 14, which is rotatably mounted in a floating bearing 15, which is arranged in a bearing opening 16 of the first traction sheave 4, is provided on a bearing vertical wall 13 arranged opposite the drive vertical wall 10. The first drive 7, the first gearing 8, the bearing journal 14 and the floating bearing 15 are oriented concentrically with respect to one another along the rotational axis 6.

The first traction sheave 4, at its outer cylinder casing face, has four grooves 17, which are used to guide the cable during the winding and unwinding of a cable from the first traction sheave 4. The grooves 17 are in each case separated by groove rims arranged in between. Furthermore, the first traction sheave 4 has flanks 18 directed obliquely outwardly from the grooves 17.

The second traction sheave 5 is held in an identical manner on the receiving frame 3. The second traction sheave 5 can be driven about its rotational axis 19 by means of a second drive 20 by means of a second gearing 21. The only difference is that the second traction sheave 5 has three instead of four grooves 17. As a result, a guidance of a cable 22 shown by a dash-dot line in FIG. 3 is made possible. According to FIG. 3, the cable 22 runs from the top left, coming from the load receiving device, into the first traction sheave 4. The cable 22 is wound along the grooves 17 of the traction sheaves 4, 5. The number of loops 23 of the cable 22 is produced from the number of grooves 17 of the two traction sheaves 4, 5. Since the first traction sheave 4 has one groove 17 more than the second traction sheave 5, the cable 22 is deflected on the traction sheaves 4, 5 of the device 2 in such a way that an inlet 24 of the cable 22, coming from the load receiving device, and an outlet 25 of the cable 22 toward a cable drive, are arranged in the same plane. FIG. 3 shows the inlet 24 at the top left and the outlet 25 at the bottom right. The inlet 24 and the outlet 25 are parallel to one another.

The device 2 furthermore has a control unit, not shown in FIGS. 1 to 4 and described below, which has a signal connection to the drives 7, 20. The control unit is used to control the drive torque and/or the drive rotational speed of the drives 7, 20. In addition or as an alternative, each drive 7, 20 may have an automatic torque control, not shown, which is called a mooring control. The pump pressure is used as the control variable for the mooring control. The predetermined pressure is kept constant by the pump, from which a constant torque follows at the hydraulic motors of the traction sheave drive, regardless of the rotational direction of the drives The mode of functioning of the device 2, in other words a method for influencing a cable winch force acting on a cable drive, will be described in more detail below with the aid of FIGS. 5 to 8.

Figure 5:
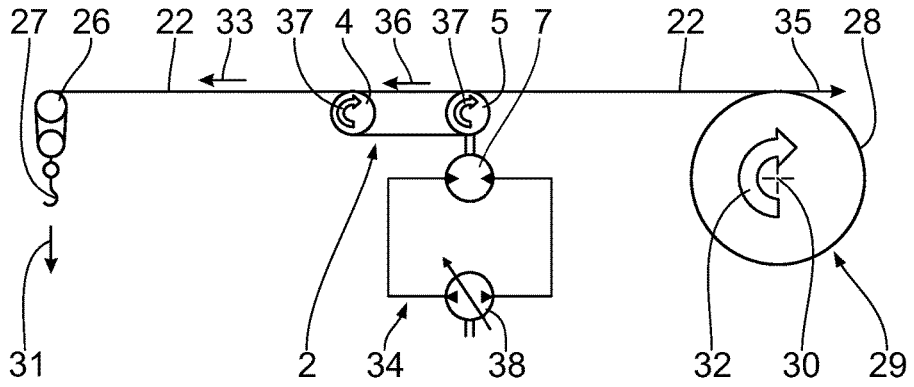
FIG. 5 shows a schematic diagram of the device with forces acting on a cable of a cable drive in a traction sheave drive operating state no-load lifting.

The device 2 is connected at a first cable end of the cable 22, shown on the left in FIG. 5, by means of a cable pulley 26 of the upper and lower load block to the load receiving device in the form of a hook block 27 shown symbolically. With multiple cable receiving, a plurality of cable pulleys 26 may also be provided. Furthermore, the device 2 at a second cable end of the cable 22, shown on the right in FIG. 5, is connected to a winch 28. The winch 28 is part of the cable drive designated 29 as a whole. The cable drive 29 has a drive, not shown, for driving the winch 28 about the rotational axis 30 of the winch. According to the view in FIG. 5, no load is suspended on the hook block 27. A load force 31 introduced by the hook block 27 is small and is substantially based on the inherent weight of the hook block 27 and the cable 22. In FIG. 5, the cable 22 is wound by the cable drive 29 onto the winch 28. For this purpose, the winch 28 is rotated according to FIG. 5 in the clockwise direction about the rotational axis 30 of the winch along the rotational direction 32 of winding. A cable drive operating state is thereby fixed, in other words, in particular, by the predetermining of the rotational direction 32 of winding of the winch 28. FIG. 5 shows the traction sheave drive operating state no-load lifting.

The outer cable force 33 acting on the cable drive 29 is determined by means of a cable force measuring device, not shown, which may be configured, in particular, as a load torque limiter that is present in any case on a crane. The outer cable force 33 provides the prestressing, with which the cable 22 is wound onto the winch 28. The cable force 33 determined can, in particular, be used as an input signal for the control unit 34 of the device 2. As an alternative to the cable force measuring device, which allows a direct determination of the outer cable force 33, it is also possible to indirectly determine the outer cable force 33 from the load force 31. The indirect determination of the outer cable force 33 is possible in an uncomplicated manner. In particular, the apparatus outlay for this is small.

The cable 22 is wound using a cable winch force 35 onto the winch 28. In order to ensure that in the operating state no-load lifting, the cable 22 is wound with adequate prestressing, in other words not too loosely, onto the winch 28, the traction sheaves 4, 5 of the device 2 are activated and, in particular controlled, in such a way that a traction sheave cable force 36 on the cable 22 counteracts the cable winch force 35. The cable winch force 35 is controlled by the traction sheave cable force 36. The cable winch force 35 is the resultant of the traction sheave cable force 36 and outer cable force 33. The outer cable force 33 is produced from the load force 31 depending on the loading condition from the system, comprising the cable 22, the load block, or a simple load receiving device. The outer cable force 33 counteracts the cable winch force 35. This means that the outer cable force 33 and the cable winch force 35 compensate one another. The outer cable force 33 and the cable winch force 35 are the same in terms of amount, in particular during conventional operation of the device, and mutually cancel one another. A resulting force formed from these two forces 33, 35 is 0. In order to be able to change the cable winch force 35 with a predetermined outer cable force 33, in particular to increase or reduce it, the traction sheave drive 2 is inserted. Depending on the load condition and operating type, the cable winch force 35 can be increased or reduced by the traction sheave cable force 36. In particular, the direction of action of the traction sheave cable force 36 can be adjusted by the drive direction of the traction sheaves 4, 5. The traction sheave cable force 36 can thus be adjusted to be in the same or opposite direction to the cable winch force 35.

Figure 10:
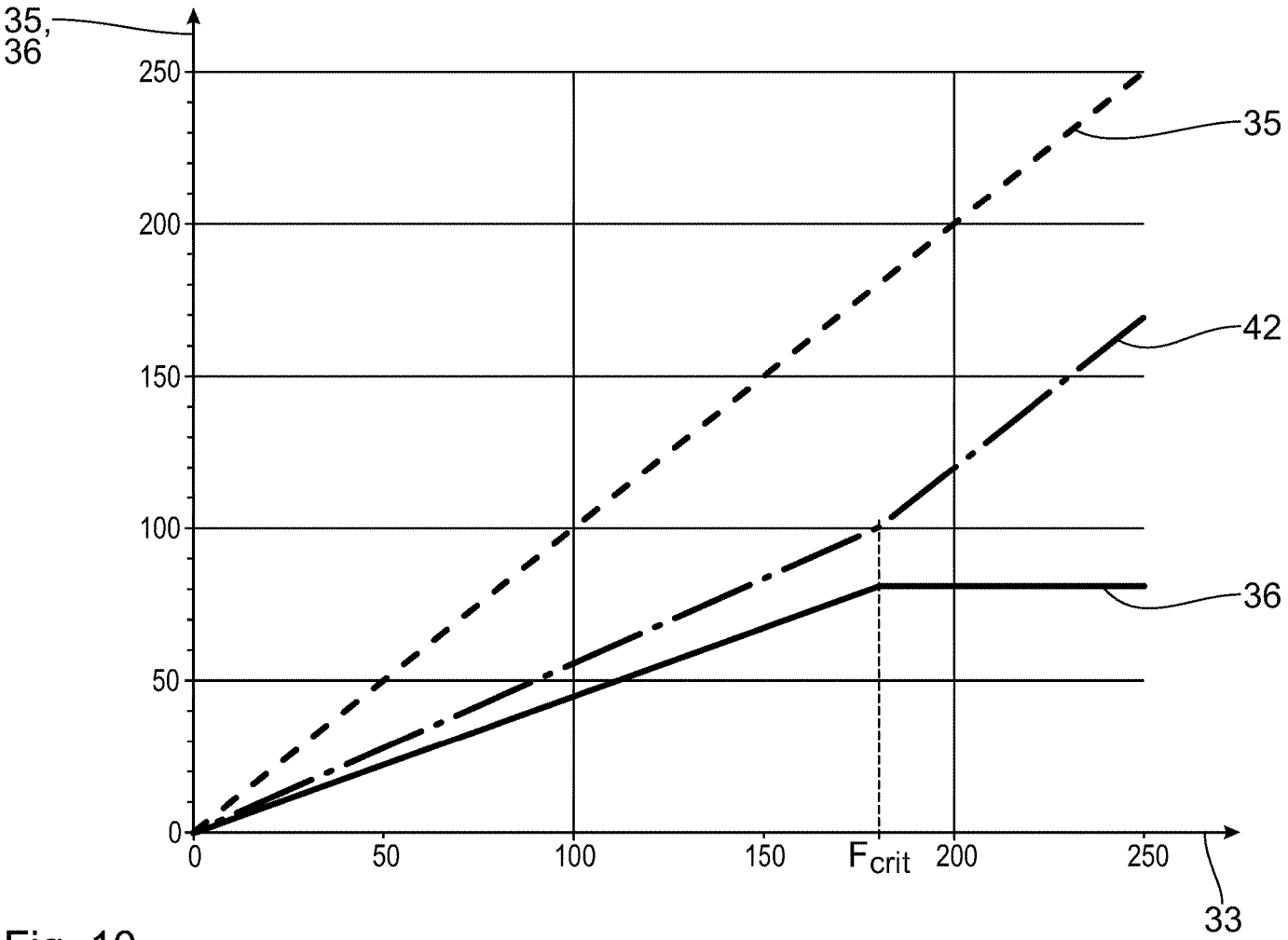

The interrelation of the cable forces 33, 35 and 36 is graphically shown in the characteristic curve graph according to FIG. 10, in that the cable winch force 35 and the traction sheave cable force 36 are in each case shown as a function of the outer cable force 33. By way of example, the respective forces are given in N in FIG. 10. The characteristic curve graph shows purely qualitatively the interrelations between the forces 33, 35 and 36. The cable winch force 35 is shown as a dashed line in the characteristic curve graph according to FIG. 10. The cable winch force 35 is identical to the outer cable force 33 if no traction sheave cable force 36 is provided. Accordingly, the cable winch force 35 is a line through the origin with the slope 1. The traction sheave cable force 36 is shown in FIG. 10 by means of a continuous line. The continuous line corresponds to a possible predetermined characteristic curve for the traction sheave cable force 36. The traction sheave cable force 36 has a linearly rising region, the slope of the characteristic curve being smaller than that of the cable winch force 35. On reaching or exceeding a critical outer cable force 33 $F_{crit}$, which, according to the characteristic curve graph shown, is 180 N, the traction sheave cable force 36 follows a plateau, i.e. the traction sheave cable force 36 is constant for an outer cable force 33, which is greater than $F_{crit}$. The characteristic curve 36 can also have a falling portion. The characteristic curve can, at least in portions, also be non-linear and, in particular, have a square, cubic, exponential, logarithmic or otherwise curved functional course. Furthermore, a dash-dot line 42 is shown in FIG. 10. The dash-dot line 42 shows the course of the cable winch force 35, which is reduced by the traction sheave cable force following the characteristic curve 36. This applies to the operating states no-load lifting (FIG. 5) and no-load lowering (FIG. 8). It is also possible for the characteristic line 36 to be added to the cable winch force 35. This applies to the operating states load lifting (FIG. 6) and load lowering (FIG. 7).

In order to ensure the traction sheave cable force 36 according to FIG. 5, the traction sheaves 4, 5, which rotate in the same direction as the winding rotational direction 32 along a traction sheave rotational direction 37 about the respective rotational axis 6, 19, are driven with a drive torque in the same direction. The two traction sheaves 4, 5 are driven by a hydraulic drive 7, which is supplied by a hydraulic pump 38 with hydraulic medium, controlled by the control unit 34.

Figure 6:
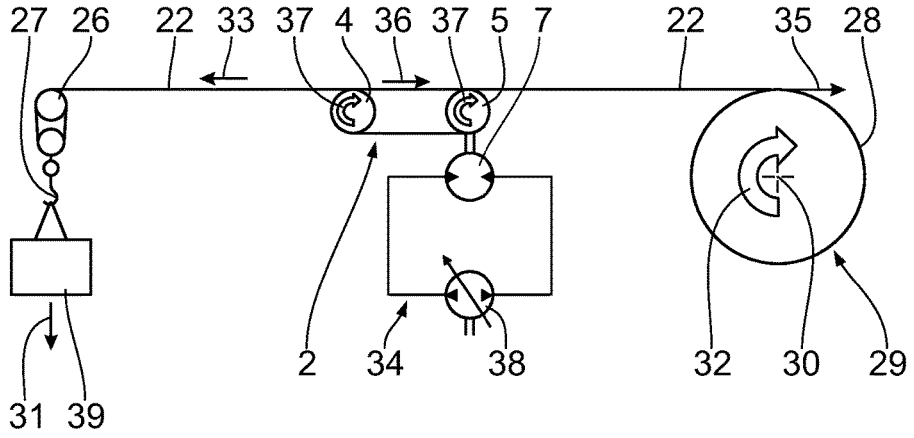
FIG. 6 shows a view corresponding to FIG. 5 in a traction sheave drive operating state load lifting.

The traction sheave drive operating state load lifting according to FIG. 6 differs from that according to FIG. 5 in that an outer load 39 is attached to the hook block 27. The load force 31 is comparatively high. Because of the high load force 31, the drives 7, 20 are activated by the control unit 34 with a drive torque in such a way that the traction sheaves 4, 5 are driven, assisting the winch 28, along the traction sheave rotational direction 37. As a result, a traction sheave cable force 36 is brought about on the cable 22 and acts in the same direction as the cable winch force 35. This means that the traction sheave cable force 36 caused by the traction sheaves 4, 5 relieves the winch 28. The cable 22 is wound onto the winch 28 at the cable winch force 35, the cable winch force 35 being less than the outer cable force 33. This can avoid the cable 22 being wound too tightly as a result of a high load 39. Unacceptably high elongations of the cable 22 are avoided.

Figure 7:
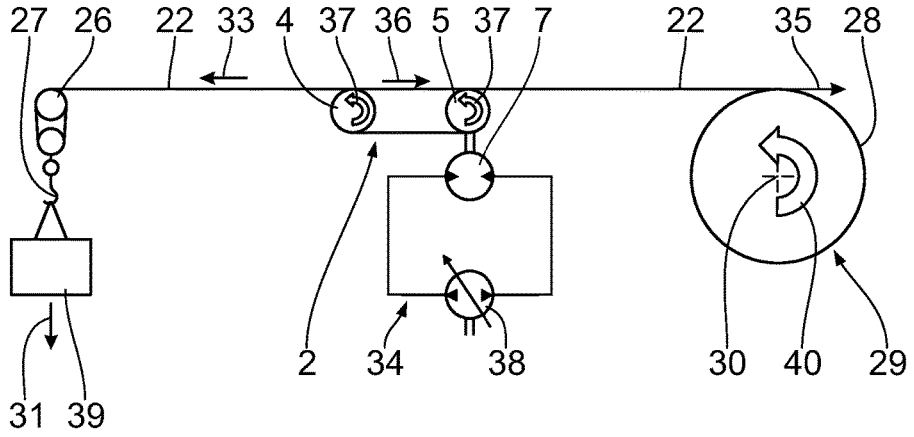
FIG. 7 shows a view corresponding to FIG. 5 in a traction sheave drive operating state load lowering.
Figure 8:
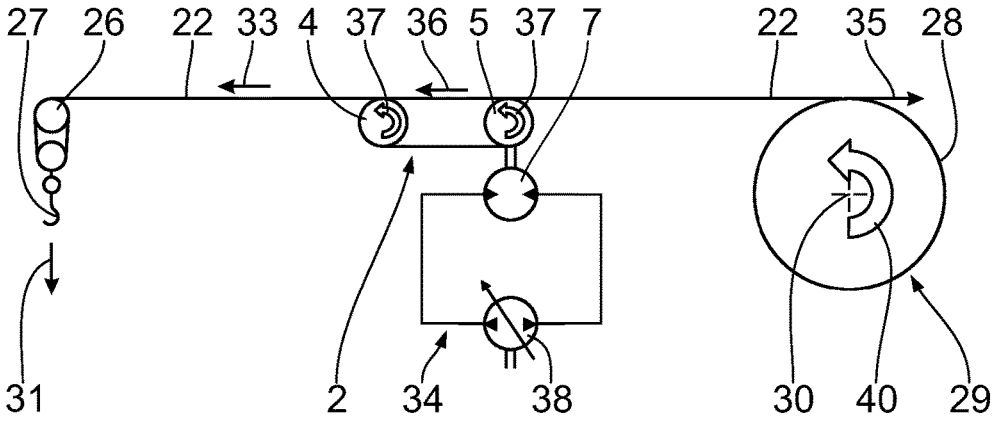
FIG. 8 shows a view corresponding to FIG. 5 in a traction sheave drive operating state no-load lowering.

The traction sheave drive operating state load lowering according to FIG. 7 differs from the operating state according to FIG. 6 in that the load 39 is lowered, i.e. the winch 28 is rotated about the rotational axis 30 along the unwinding rotational direction 40. The cable 22 is unwound from the winch 28. In order to reduce the high load force 31 as a result of the load 39, the traction sheaves 4, 5 of the device 2 are activated by the control unit 34 in such a way that the traction sheaves 4, 5 are loaded with a drive torque directed counter to the unwinding rotational direction 40. The traction sheave cable force 36 acts in a relieving manner in the same direction as the cable winch force 35 in order to avoid too high a traction load of the load 39 during unwinding. The cable 22 is decelerated by the device 2 during unwinding. The device 2 relieves the winch 28.

The traction sheave drive operating state no-load lowering shown in FIG. 8 differs according to the state shown in FIG. 7 in that the cable 22 is unwound without a load. Accordingly, the winch 28 is rotated about the rotational axis 30 along the unwinding rotational direction 40. Since no load is suspended on the hook block 27, the load force 31 is small. So that the cable winch force 35 is large enough when unwinding the cable 22 from the winch 28, a traction sheave cable force 36 is provided by the device 2, which counteracts the winch force 35. The traction sheave cable force 36 thus brings about an unwinding with a predetermined cable winch force 35, in that the cable 22 is drawn off from the winch 28 by means of the device 2. In this case, the cable winch force 35 is greater than the outer cable force 33.

Figure 9:
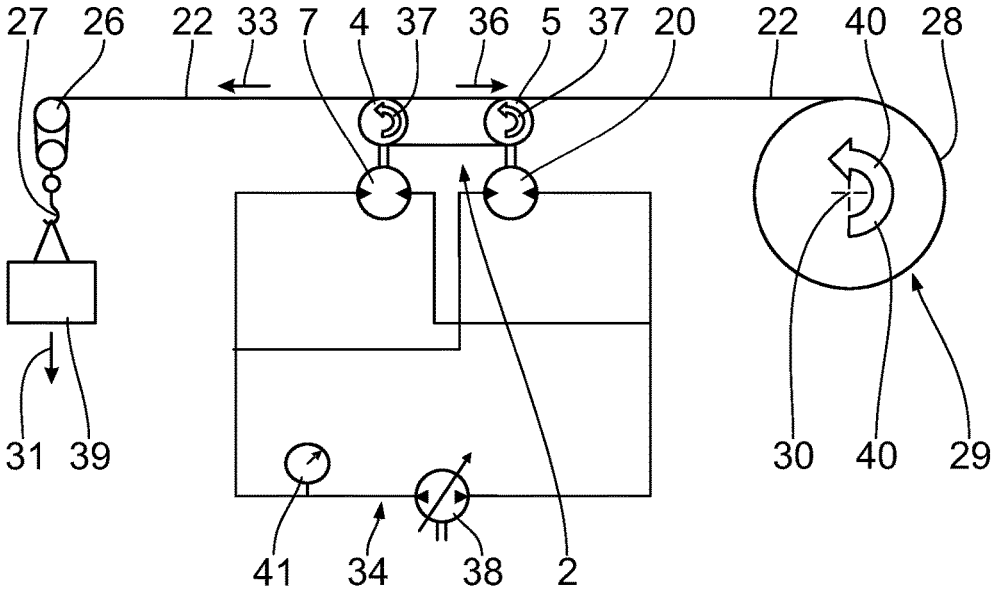
FIG. 9 shows a schematic view of a closed hydraulic circuit for the device according to the invention and FIG. 10 shows a view of a characteristic curve for controlling the cable winch force

The mode of functioning of the hydraulic control will be described in more detail below with the aid of FIG. 9 and the traction sheave drive operating state load lowering according to FIG. 7. The hydraulic drives 7, 20 are controlled in such a way that, depending on the outer cable force 33 and the traction sheave rotational direction 37, the drive torques of the traction sheaves 4, 5 bring about the traction sheave cable force 36. In the embodiment shown according to FIG. 9, the drive torques of the hydraulic drives 7, 20 are realised by means of an automatic torque control. The drives 7, 20 are activated by means of a hydraulic pump 38 working in a closed hydraulic circuit. The amount and the direction of the drive torque are controlled by means of a pressure unit 41 at the pump.

What is claimed is:

1. A method for influencing a cable winch force (35) acting on a cable drive (29), comprising the steps:

providing a cable drive (29) with a drivable winch (28) and a cable (22) that is wound on the winch (28), providing a traction sheave drive (2) for producing a traction sheave cable force (36) on the cable (22), determining an outer cable force (33), predetermining a cable drive operating state depending on a rotational direction of the winding of the winch, providing a control-regulating unit (34) to influence the traction sheave cable force (36), producing a control-regulating variable by the control-regulating unit (34) depending on the outer cable force (33) and the predetermined cable drive operating state, producing the traction sheave cable force (36) by the traction sheave drive (2) and influencing the traction sheave cable force (36) by the control-regulating unit (34) in such a way that the cable winch force (35) acting on the cable drive (29) is controlled depending on the respective cable drive operating state and the outer cable force (33), determining a current operating traction sheave drive operating state depending on whether a load is attached to the cable (22) and whether the cable is being lifted or lowered, the traction sheave drive being operable in four traction sheave drive operating states: no-load lifting where the cable is being lifted and no load is attached to the cable, no-load lowering where the cable is being lowered and no load is attached to the cable, load lifting where the cable is being lifted and a load is attached to the cable, and load lowering where the cable is being lowered and a load is attached to the cable, and wherein the control-regulating unit (34) controls the traction sheave drive depending directly on the determined current operating traction sheave drive operating state and the control-regulating variable, such that winding and unwinding the cable (22) is provided in a controlled manner at a constant cable winch force (35).

2. A method according to claim 1, wherein the cable winch force (35) acting on the cable drive (29) is controlled in such a way that the cable winch force is reduced relative to the outer cable force (33).

3. A method according to claim 1, wherein the cable winch force (35) acting on the cable drive (29) is controlled in such a way that the cable winch force is increased relative to the outer cable force (33).

4. A method according to claim 1, wherein the cable winch force (35) acting on the cable drive (29) is controlled in such a way that the traction sheave cable force (36) follows a predetermined characteristic curve depending on the outer cable force (33).

5. A method according to claim 1, comprising an indirect determination of the outer cable force (33) from a load force (31).

6. A method according to claim 1, comprising a direct determination of the outer cable force (33) by means of a cable force measuring device.

7. A method according to claim 1, comprising determining the traction sheave cable force (36) transmitted by the traction sheave drive (2) from the outer cable force (33).

8. A method according to claim 1, comprising a consideration of the rotational direction (32, 40) of the winch (28), which is predetermined to produce the control-regulating variable.

9. A method according to claim 8, wherein the rotational direction (32, 40) of the winch is predetermined by an operator.

10. A method according to claim 1, wherein a plurality of input variables is used to produce the control-regulating variable.

11. A method according to claim 10, wherein the input variables include at least one of the group comprising the outer cable force (33), a load force (31), a rotational direction (32, 40) of the winch (28) and a rotational speed of the winch (28).

12. A method according to claim 1, comprising a control of the traction sheave cable force (36) in such a way that the resulting cable winch force (35) is independent of the rotational speed of the winch (28).

* * * * *